US009963870B2

(12) United States Patent
Merlob

(10) Patent No.: US 9,963,870 B2
(45) Date of Patent: May 8, 2018

(54) STRUCTURAL CRACK REPAIR APPARATUS AND METHOD

(71) Applicant: Darren E. Merlob, Calabasas, CA (US)

(72) Inventor: Darren E. Merlob, Calabasas, CA (US)

( * ) Notice: Subject to any disclaimer, the term of this patent is extended or adjusted under 35 U.S.C. 154(b) by 65 days.

(21) Appl. No.: 14/536,438

(22) Filed: Nov. 7, 2014

(65) Prior Publication Data

US 2015/0068154 A1 Mar. 12, 2015

Related U.S. Application Data

(62) Division of application No. 10/882,573, filed on Jul. 1, 2004.

(51) Int. Cl.

| | |
|---|---|
| ***E04B 1/41*** | (2006.01) |
| ***E04G 23/02*** | (2006.01) |
| *E04C 5/16* | (2006.01) |

(52) U.S. Cl.

CPC ..... *E04B 1/41* (2013.01); *E04G 23/0203* (2013.01); *E04G 23/0218* (2013.01); *E04C 5/163* (2013.01)

(58) Field of Classification Search

CPC ..... E04G 23/0203; E04G 23/0214; E04G 23/0218

See application file for complete search history.

(56) References Cited

U.S. PATENT DOCUMENTS

| | | | | |
|---|---|---|---|---|
| 1,882,462 A | | 10/1932 | Weber | |
| 1,905,405 A | | 4/1933 | Winslow | |
| 2,838,145 A | | 6/1958 | Schulte | |
| 3,168,941 A | | 2/1965 | Southard | |
| 3,758,939 A | * | 9/1973 | Galvani | B22D 7/066 29/402.12 |
| 4,360,994 A | | 11/1982 | Hodges | |
| 5,063,006 A | | 11/1991 | Tahara | |
| 5,115,622 A | * | 5/1992 | Ammann | E04G 23/0218 52/231 |
| 5,155,965 A | | 10/1992 | Tabei et al. | |

(Continued)

FOREIGN PATENT DOCUMENTS

| | | | |
|---|---|---|---|
| RU | 2055715 | | 3/1996 |
| RU | 2055715 C1 | * | 3/1996 |
| SU | 366053 A1 | * | 1/1973 |

OTHER PUBLICATIONS archive.org "Torque Lock Testimonials" Archived Sep. 25, 2004, <http://www.torque-lock.com/testiomnials.php>.*

(Continued)

*Primary Examiner* — Jacob Cigna
(74) *Attorney, Agent, or Firm* — Fulwider Patton LLP

(57) ABSTRACT

A structural crack repair apparatus is disclosed. The apparatus includes at least one staple having an elongated torque plate, a pair of reinforcing rods and a pair of rotatable cam members provided on the torque plate and engaging the respective cam members. According to the method, the reinforcing rods are inserted in rod apertures provided in the surface on opposite sides of the crack. The cam members are selectively rotated to cause radial displacement of the reinforcing rods with respect to a geometric center of the cam members to cause tight engagement of the reinforcing rods with the interiors of the rod apertures.

22 Claims, 13 Drawing Sheets

(56) References Cited

U.S. PATENT DOCUMENTS

| | | | | |
|---|---|---|---|---|
| 5,223,272 | A | 6/1993 | Pringle | |
| 5,309,692 | A | 5/1994 | Hayashi et al. | |
| 5,476,340 | A * | 12/1995 | Contrasto | E01C 7/147 264/35 |
| 5,635,116 | A | 6/1997 | Einiger et al. | |
| 5,675,619 | A | 10/1997 | Erbes et al. | |
| 5,771,557 | A | 6/1998 | Contrasto | |
| 6,167,618 | B1 * | 1/2001 | Weems | G21C 5/10 29/402.14 |
| 6,187,124 | B1 | 2/2001 | Campfield | |
| 6,212,750 | B1 | 4/2001 | Reed | |
| 6,355,038 | B1 | 3/2002 | Pisharodi | |
| 6,532,714 | B1 * | 3/2003 | Ferm | E01C 7/147 404/64 |
| 7,272,996 | B2 | 9/2007 | Pontieri | |
| 7,513,024 | B2 * | 4/2009 | Keller | B23P 6/04 29/402.09 |
| 2007/0050963 | A1 | 3/2007 | Keller | |
| 2015/0300033 | A1 * | 10/2015 | Weber | E04G 23/0203 52/514 |

OTHER PUBLICATIONS archive.org "Torque Lock Installation PDF" Archived Sep. 25, 2004, <http://web.archive.org/web/20040927225746/http://www.torque-lock.com/images/TL_form.pdf>.*

* cited by examiner

STRUCTURAL CRACK REPAIR APPARATUS AND METHOD

RELATED APPLICATIONS

This is a divisional of application Ser. No. 10/882,573, filed on Jul. 1, 2004, the entire contents of which are incorporated herein by reference.

FIELD OF THE INVENTION

The present invention relates generally to apparatus for repairing cracks in floors, walls and other surfaces. More particularly, the present invention relates to a novel structural crack repair apparatus and method which facilitates the repair of cracks in walls, floors and surfaces of a variety of above-ground structures as well as various subterranean structures such as swimming pools.

DESCRIPTION OF THE PRIOR ART

A variety of structures such as houses, buildings, walls, fences and swimming pools, for example, have concrete surfaces. Concrete elements in such structures not only provide substantial reinforcement to the structures but also impart a pleasing aesthetic appearance to the structures. However, one of the problems associated with concrete structures is that cracks frequently form in the surfaces of the structures after a prolonged period of time. Therefore, a variety of techniques have been developed to repair cracks in concrete and other surfaces.

U.S. Pat. No. 4,360,994 describes a concrete crack sealing system, which includes injecting a liquid latex into a crack, covering the exposed surface of the crack with an impermeable barrier, and injecting a low-viscosity liquid latex through the barrier into the crack. The liquid latex cures into a solid, elastomeric state. However, the system disclosed in the '994 patent does not include heavy-duty mechanical elements which engage the concrete on opposite sides of the crack to prevent widening of the crack over time.

U.S. Pat. No. 5,063,006 discloses methods for repairing cracks in concrete structures by attaching over a crack a series of cutoff agent-sealing members. A blowing resin is introduced under pressure into internal chambers of the members to elevate the pressure within the members. Inlet and outlet valves of the chambers are closed, causing elevated pressure in the chambers to push the cutoff agent deeply into the interior of the crack and seal the crack. However, the method disclosed in the '006 patent lacks the use of mechanical elements to engage the concrete on opposite sides of the crack and prevent further widening of the crack.

U.S. Pat. Nos. 5,476,340 and 5,771,557 each disclose an internal metal stitching method for stitching a crack in a concrete surface. Slots are cut in the concrete on opposite sides of the crack every two feet, and metal brackets are installed in the slots at alternating angles to the crack. The slots containing the brackets are then filled with a resin material and then smoothed out to the level of the concrete surface. However, because the brackets must be installed every two feet, the stitching method is time-consuming, laborious and requires a large number of brackets. Furthermore, the disclosed methods do not compress, and thereby stabilize, the crack.

Another method of repairing cracks is detailed in U.S. Pat. No. 6,212,750. The method includes a plurality of drilling fixtures, which facilitate the creation of one or more lock-receiving recesses positioned generally transverse to the casting crack. The lock-receiving recesses are formed of a single-sized circular bore combination having alternating double and single circular portions to maximize strength. A plurality of correspondingly-shaped metal locks are inserted into the lock-receiving recesses to provide transverse metal locks which draw the casting portions on each side of the crack together. The method further includes inserting a plurality of stitching pins in threaded bores in overlapping relationship formed along the remainder of the crack. However, the method is laborious and time-consuming since the lock-receiving recesses must be cut to the same configuration and dimensions as the metal locks.

Additional crack-repairing methods and apparatus are detailed in U.S. Pat. Nos. 2,838,145 and 3,168,941 and suffer from one or more disadvantages of the prior art.

Accordingly, there is a well-established need for a structural crack repair apparatus and method which is simple in construction and is characterized by ease of installation and structural strength to prevent the further widening of a crack in a concrete surface.

SUMMARY OF THE INVENTION

The invention is directed to a structural crack repair apparatus and method which is suitable for repairing cracks in surfaces, particularly the cracked concrete surfaces of walls, floors, fences and swimming pools, for example. The structural crack repair apparatus is characterized by structural simplicity, ease of installation and imparts considerable structural strength to a cracked surface to prevent further widening and/or propagation of the crack along the surface. The structural crack repair apparatus is applicable to repairing structural cracks in a wide variety of surfaces, structural bodies and the like having various configurations and compositions.

In one general aspect of the present invention, a structural crack repair apparatus is provided for engaging a cracked concrete surface on opposite sides of a crack to be repaired. The structural crack repair apparatus comprises at least one staple, each of which includes:

an elongated torque plate;

a pair of spaced-apart cam members rotatably carried by the torque plate; and a pair of spaced-apart reinforcing rods engaged by the cam members, respectively, for insertion in respective rod openings extending into the surface on opposite sides of the crack to be repaired.

In a further aspect of the present invention, multiple staples are provided in spaced-apart relationship to each other along the crack to be repaired to prevent further widening and propagation of the crack along the surface.

In still a further aspect of the present invention, the torque plate has an elongated shaft and cam-receiving apertures provided in respective ends of the shaft for receiving the respective cam members.

In yet another aspect of the present invention, each cam member includes a circular cam body having an offset aperture for receiving the corresponding reinforcing rod and a pair of spaced-apart pegs which are engaged by a cam-driving tool to rotate the cam member in the corresponding cam-receiving aperture of the torque plate and cause tight engagement of the attached reinforcing rod against the interior of the corresponding rod opening.

In another aspect of the present invention, the torque plate has an elongated plate member and a pair of spaced-apart cam-receiving apertures provided in the plate member for receiving cam members, respectively.

In still another aspect of the present invention, the staple is characterized by a unique low profile, facilitating a crack repair method requiring a relatively shallow excavation into the repair surface.

In a still further aspect of the present invention, a method of repairing a crack in a surface is provided. The method includes:

providing an excavation cavity in the surface in transverse relationship to the crack to be repaired;

providing a pair of spaced-apart rod apertures extending from the rear or bottom of the excavation cavity into the surface;

assembling a staple having an elongated torque plate, a pair of spaced-apart cam members rotatably carried by the torque plate and a pair of reinforcing rods engaged by the cam members, respectively;

inserting the reinforcing rods into the respective rod apertures; and rotating the cam members with respect to the torque plate, such that the reinforcing rods are moved inwardly toward each other and against the interior walls of the respective rod apertures.

In yet another aspect of the method of the present invention, an epoxy is applied to the reinforcing rods or the rod apertures to secure the reinforcing rods in the respective rod apertures.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Shown throughout the Figures, the present invention is generally directed to a structural crack repair apparatus and method for repairing cracks in a surface. The apparatus incorporates a simple, low profile, and yet heavy-duty, design that facilitates ease of installation and prevents or minimizes the widening or propagation of cracks in a variety of surfaces.

Figure 6:
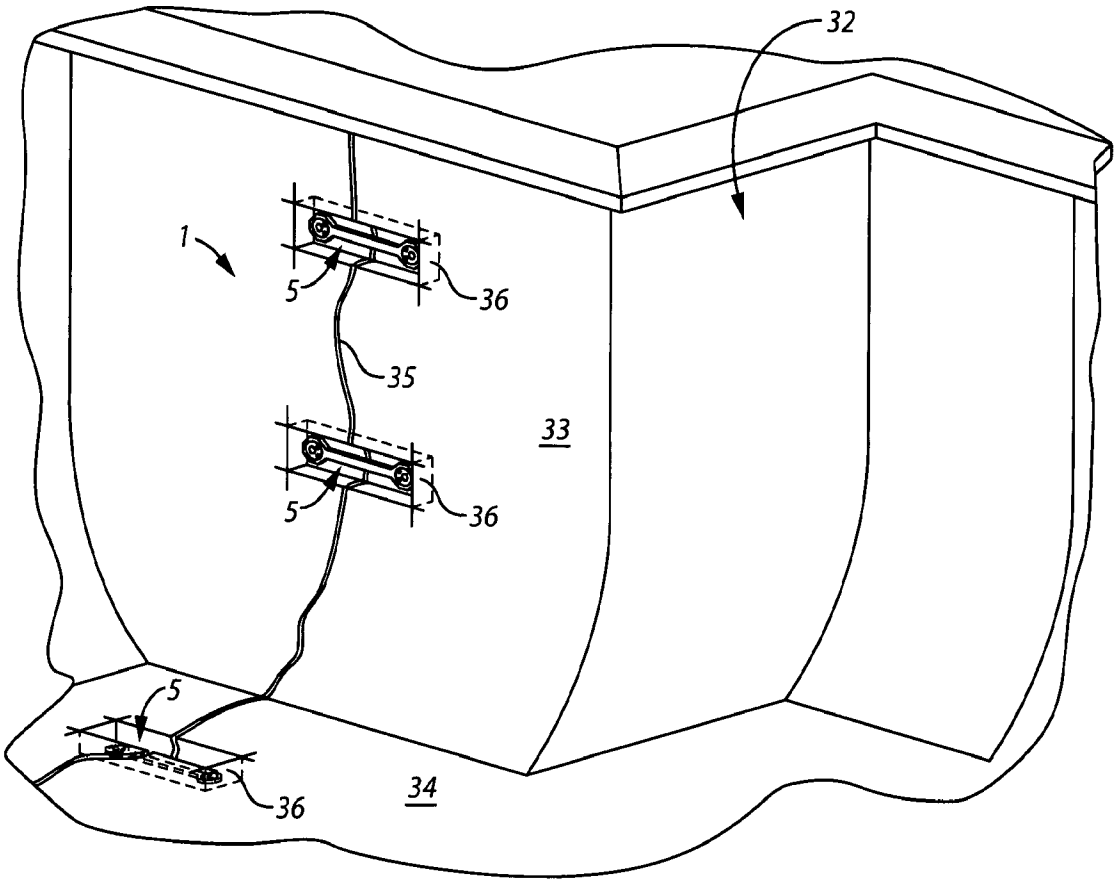
FIG. 6 is a perspective view of the pool, illustrating the staples inserted in each corresponding pair of reinforcing rods in each excavation cavity as a fifth step according to the method of the present invention.

Referring initially to FIG. 6, an illustrative embodiment of the structural crack repair system of the present invention is generally indicated by reference numeral 1. In an exemplary application of the invention, the system 1 includes at least one staple 5, and typically multiple staples, which span a crack 35 in the wall 33 and floor 34 of a swimming pool 32. The staples 5 prevent further widening and propagation of the crack 35 along the wall 33 and floor 34. While application of the invention will be hereinafter described with respect to repair of the crack 34 in the swimming pool 32, it is understood that the system 1 can be used to repair cracks in a wide variety of surfaces, structural bodies and the like having various configurations and compositions. The structural details of each staple 5, as well as a typical manner of installation, will be hereinafter further described.

Figure 13:
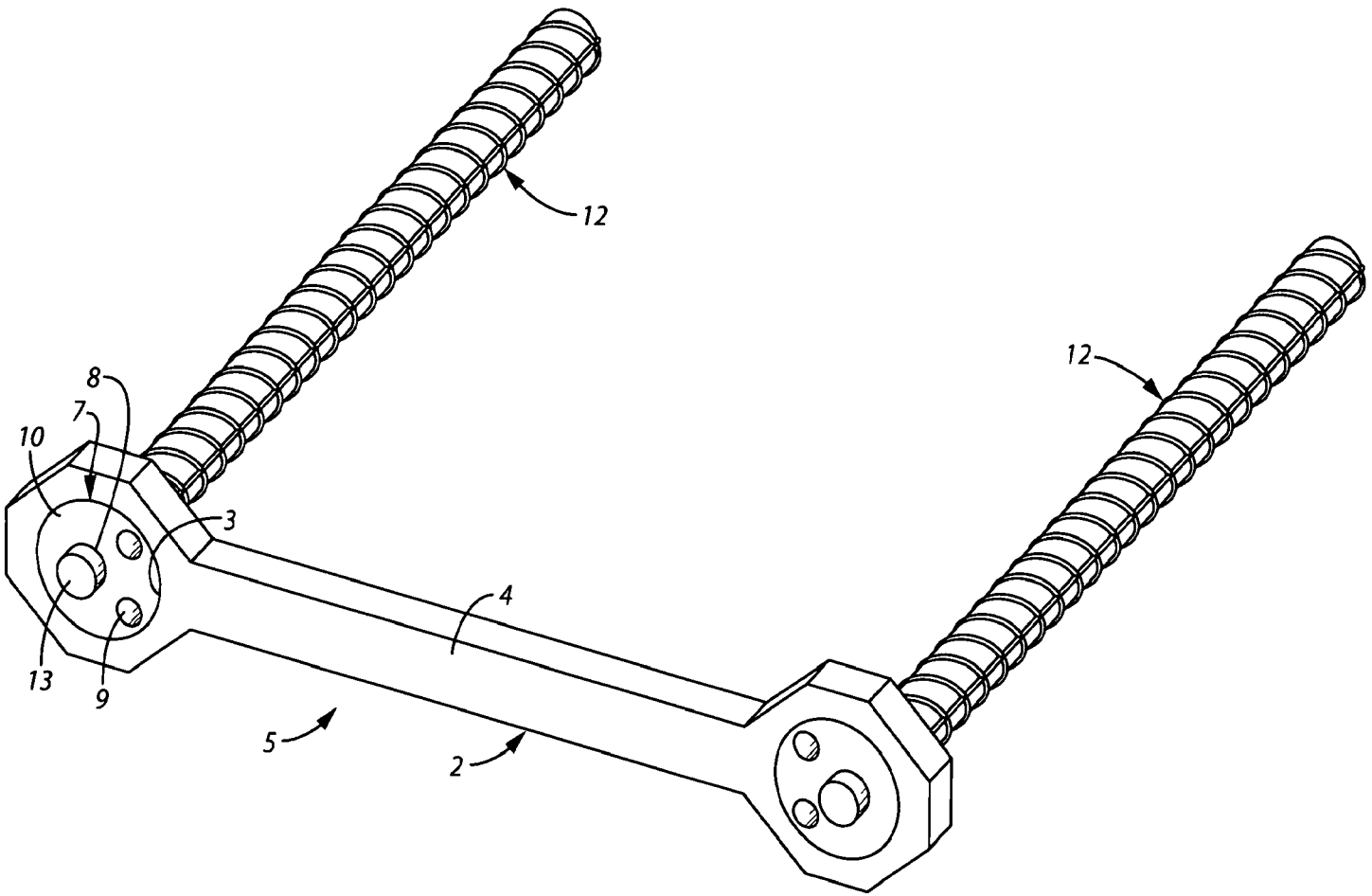
FIG. 13 is a perspective view of an assembled staple of the structural crack repair apparatus according to the present invention.
Figure 14:
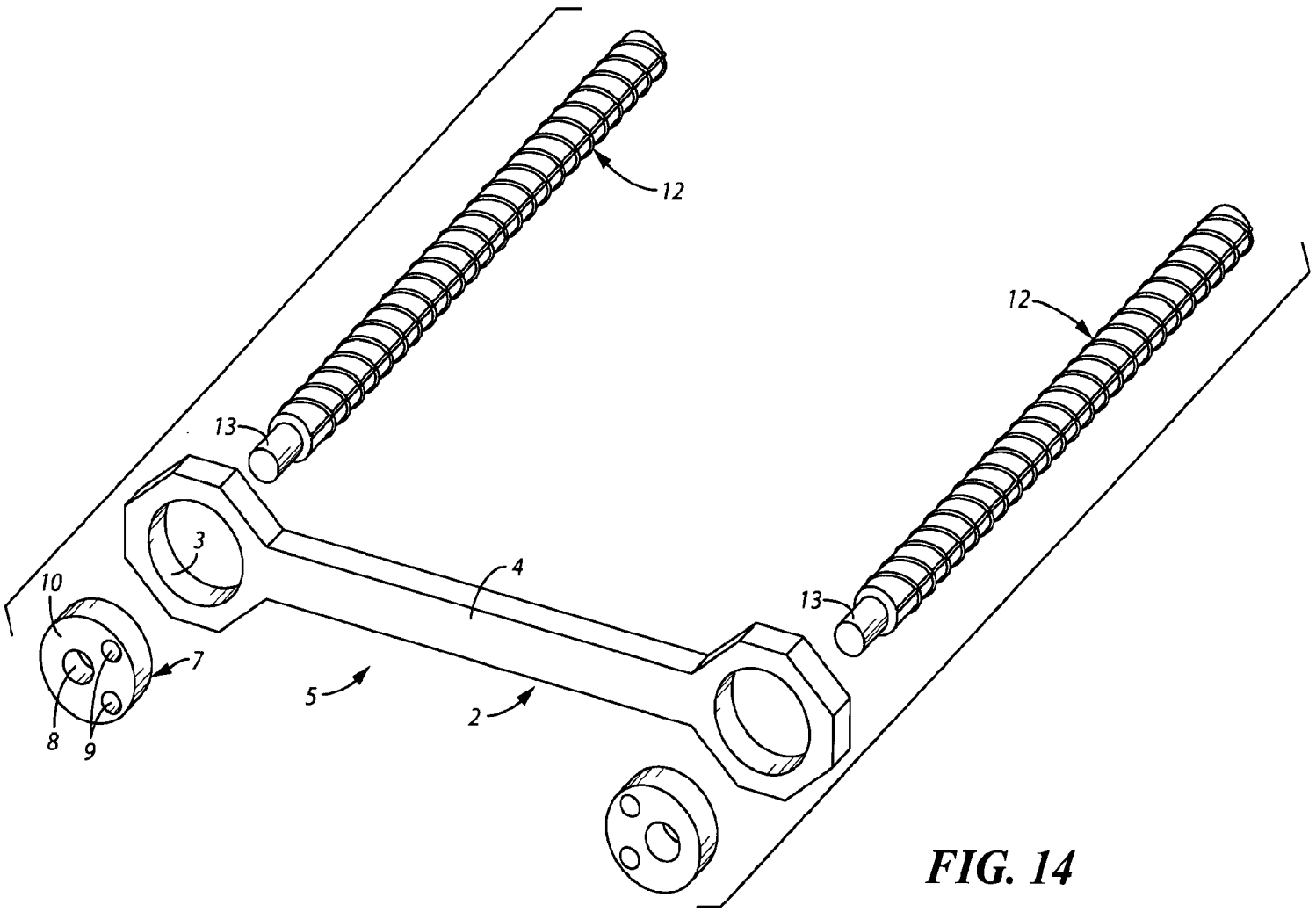
FIG. 14 is an exploded, perspective view of the staple of FIG. 13.
Figure 15:
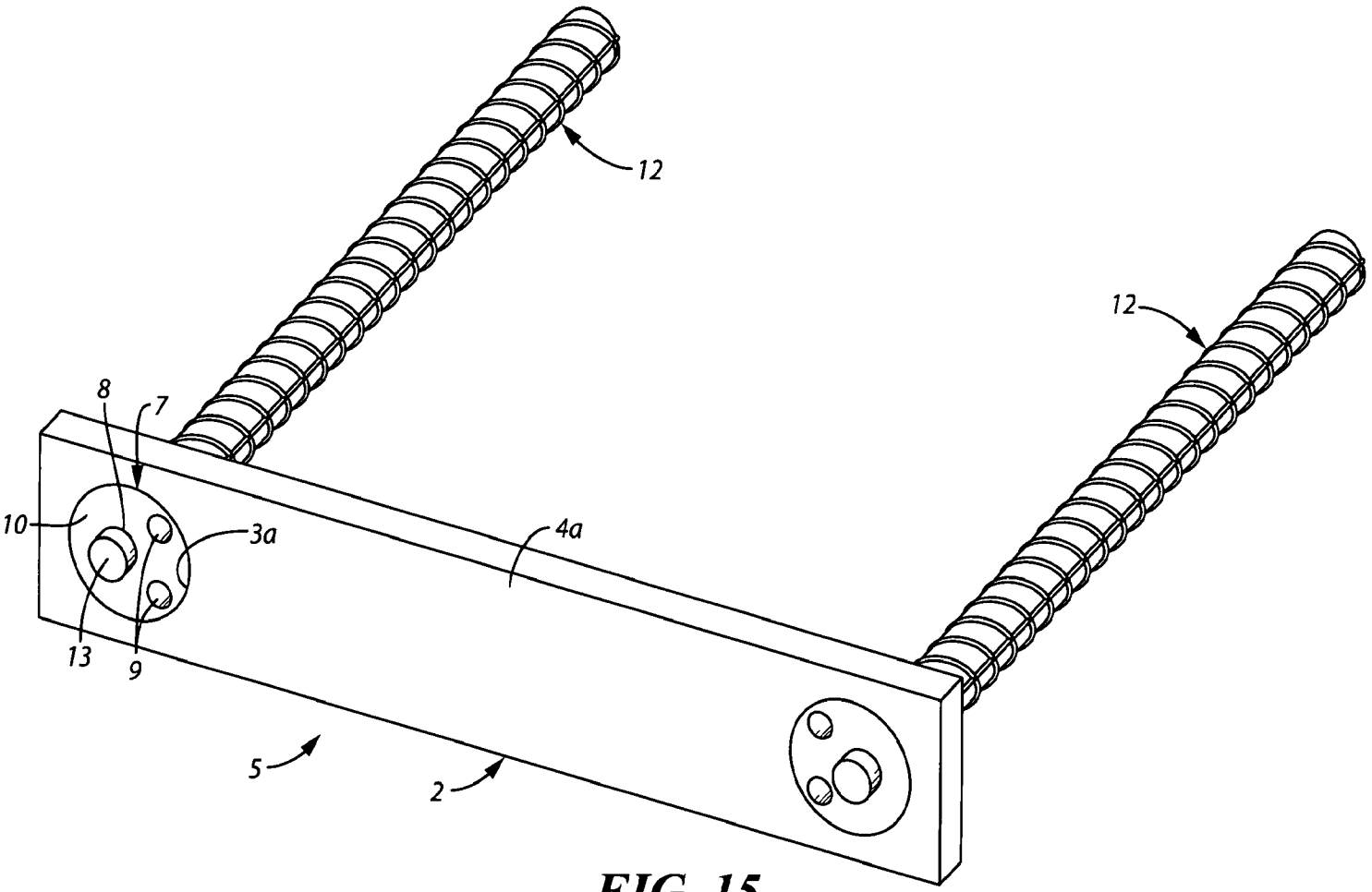
FIG. 15 is a perspective view of an assembled staple according to an alternative embodiment of the invention.

Referring next to FIGS. 13-15, each staple 5 typically includes a torque plate 2 having an elongated shaft 4. A circular cam-receiving aperture 3 extends through each end portion of the shaft 4. Accordingly, each cam-receiving aperture 3 is adapted to receive a cam member 7 in such a manner that the cam member 7 can rotate freely in the corresponding cam-receiving aperture 3. In an alternative embodiment of the staple 5*a* illustrated in FIG. 15, the torque plate 2*a* includes an elongated, rectangular plate member 4*a* and the cam-receiving apertures 3 extend through the respective end portions of the plate member 4*a*.

Figure 12:
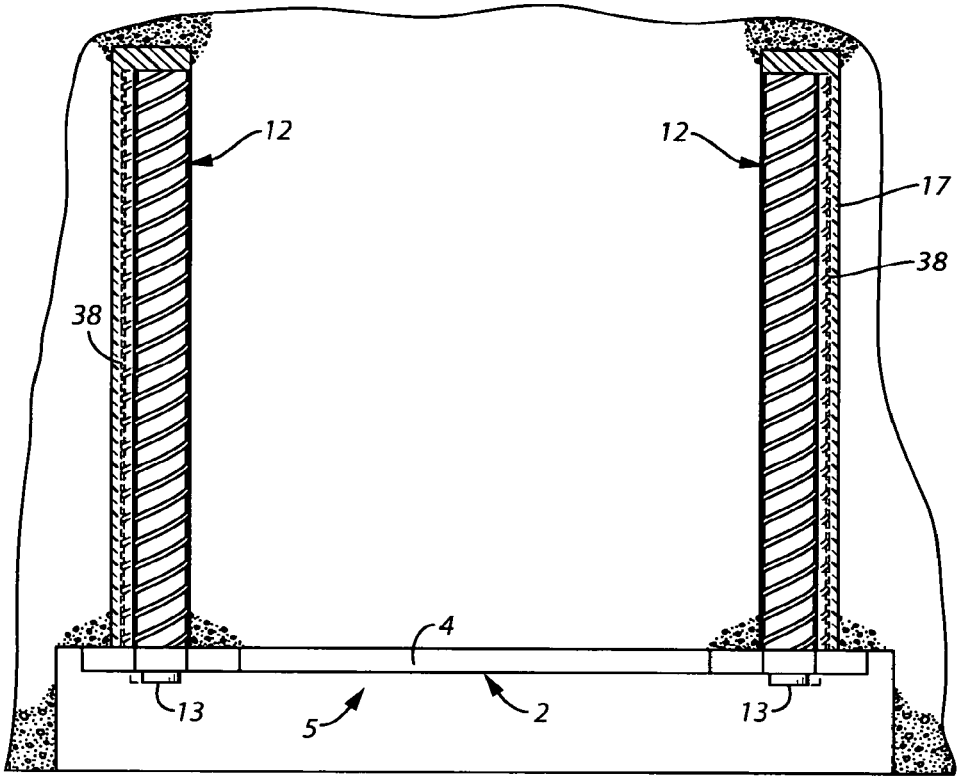
FIG. 12 is a top view of the staple of FIG. 11, after rotation of the cam members and reinforcing rods.
Figure 11:
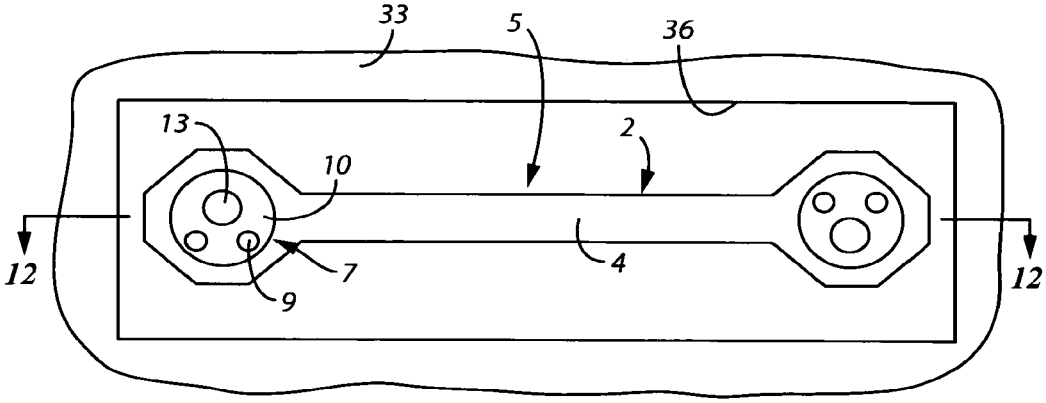
FIG. 11 is a front view of the staple of FIG. 9, after rotation of the cam members on the torque plate and engagement of the reinforcing rods with the interior surfaces of the respective rod apertures.

As particularly illustrated in FIG. 14, each cam member 7 typically includes a circular cam body 10. A pair of spaced-apart cam tool apertures 9 extend through the cam body 10 for purposes which will be hereinafter described. An offset aperture 8 extends through each cam body 10 in offset or eccentric relationship with respect to the geometric center of the cam body 10. As illustrated in FIG. 12, in the assembled staple 5, each offset aperture 8 receives the reduced diameter tip 13 of an elongated reinforcing rod 12, which is typically steel. Accordingly, as illustrated in FIG. 13, the reinforcing rods 12 extend from the respective cam members 7, in spaced-apart relationship to each other.

Figure 1:
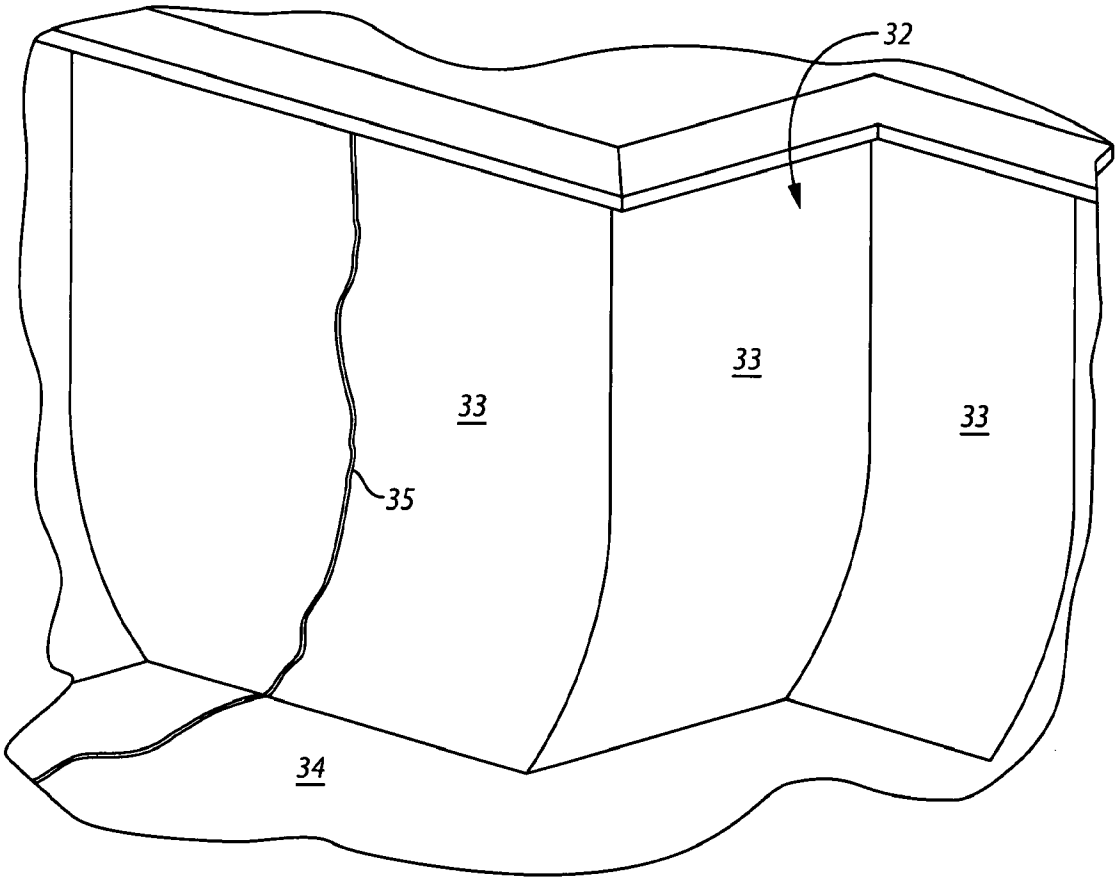
FIG. 1 is a perspective view of a drained swimming pool, partially in section, with a fracture line or crack to be repaired in the side and bottom surfaces of the pool.
Figure 2:
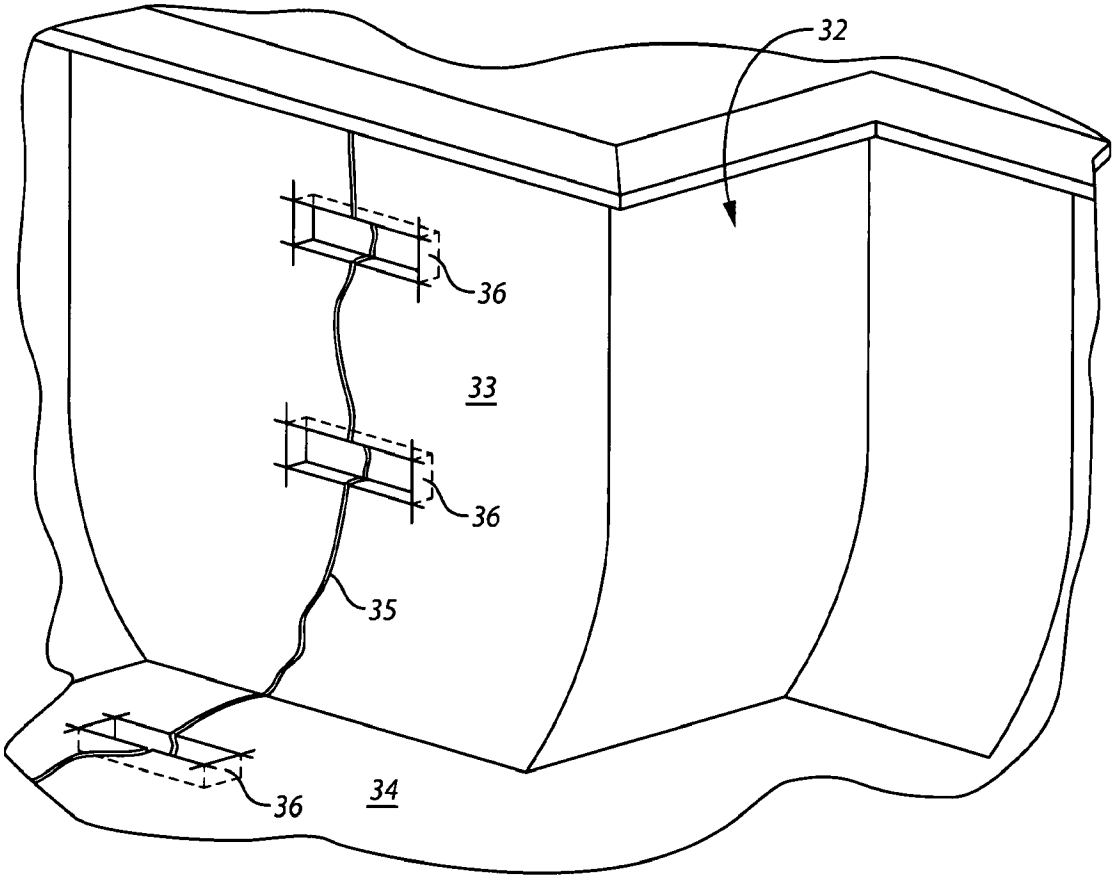
FIG. 2 is a perspective view of the drained swimming pool of FIG. 1, with excavation cavities provided in the side and bottom surfaces of the pool in transverse relationship to the crack as a first step according to the crack repair method of the present invention.

Referring next to FIGS. 1-12, in typical application of the system 1 according to the structural crack repair method of the present invention, multiple staples 5 are used to repair a fracture line or crack 35 in the wall 33 and floor 34 of a swimming pool 32. The crack 35 is shown in the untreated condition in FIG. 1. As illustrated in FIG. 2, in a first step according to the method of the invention, multiple excavation cavities 36, each of which typically has an elongated, rectangular shape, are cut in the wall 33 and floor 34 in spaced-apart relationship to each other and in transverse and intersecting relationship to the crack 35. The dimensions of each excavation cavity 36 depend on the length of the staples 5 which are to be used in the repair process. For example, in the event that the length of each of the staples 5 is 3.0 inches, each excavation cavity 36 has dimensions of typically 5.0×2.5 inches; if the length of each staple 5 is 6.0 inches, then each excavation cavity 36 has dimensions of typically 8×2.5 inches. The depth of each excavation cavity 36 is greater than the thickness of the torque plate 2 of each staple 2. Each excavation cavity 36 is thoroughly cleaned to remove debris therefrom.

Figure 3:
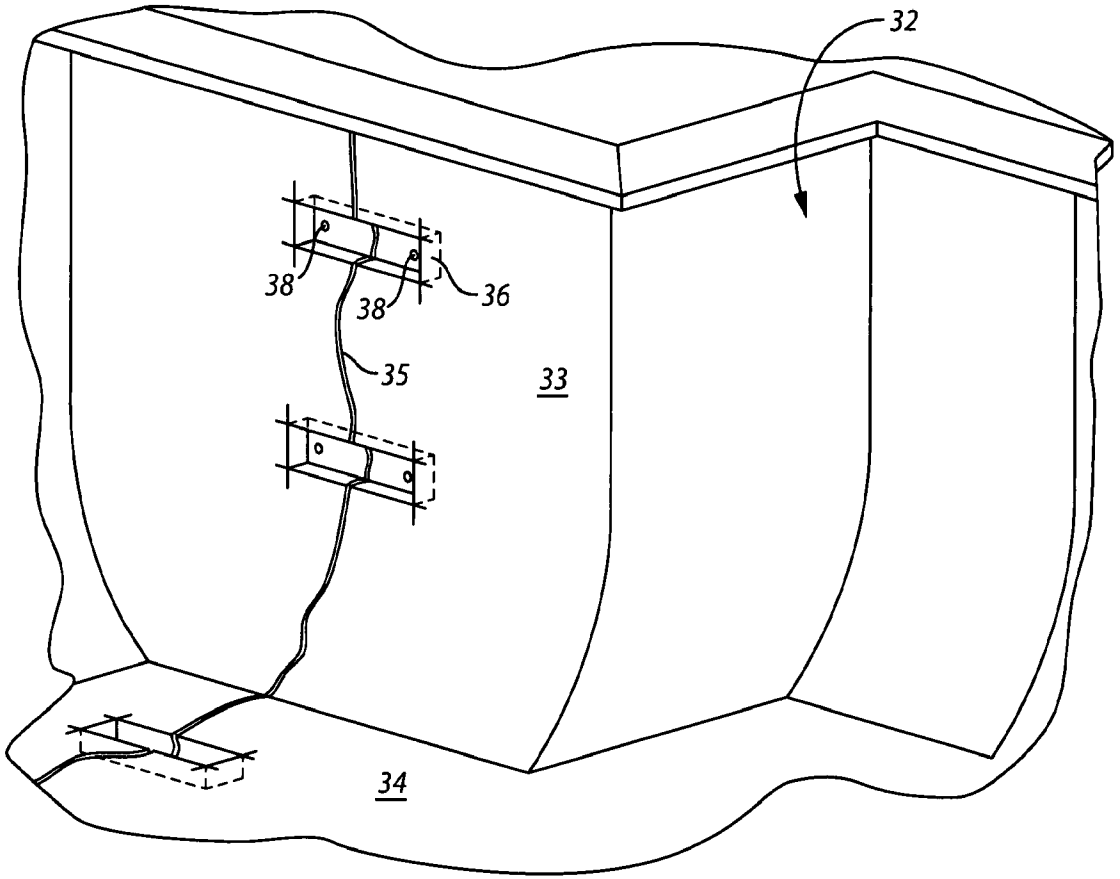
FIG. 3 is a perspective view of the pool of FIG. 2, illustrating a pair of rod apertures drilled from the rear or bottom of each excavation cavity into the surface as a second step according to the crack repair method of the present invention.

As illustrated in FIG. 3, a pair of spaced-apart rod apertures 38 is next drilled into rear surface of each excavation cavity 36 cut in the swimming pool wall 33 and the bottom surface of each excavation cavity 36 cut in the swimming pool floor 34. The locations of the rod apertures 38 may first be marked by using the assembled staple 5, with the cam members 7 inserted in the respective cam-receiving apertures 3, as a template. Accordingly, with the cam members 7 positioned in the respective cam-receiving apertures 3 in such a manner that the cam tool apertures 9 located at the inside position and the offset aperture 8 located at the outside position of each cam member 7, as illustrated in FIG. 13, the rod apertures 38 correspond to the locations of the respective offset apertures 8. Alignment means (not illustrated), such as indentations or markings, for example, may be provided in the torque plate 2 and circular cam members 7 to ensure proper orientation of the staple 5 prior to marking the locations of the rod apertures 38. The rod apertures 38 may be formed using a 0.75 inch masonry bit, for example. A typical depth for each rod aperture 38 is at least 3.25 inches for a 3.0 inch reinforcing rod and at least 6.25 inches for a 6.0 inch reinforcing rod 12. After drilling, debris is cleaned from the rod apertures 38 using compressed air, a brush or the like.

Figure 4:
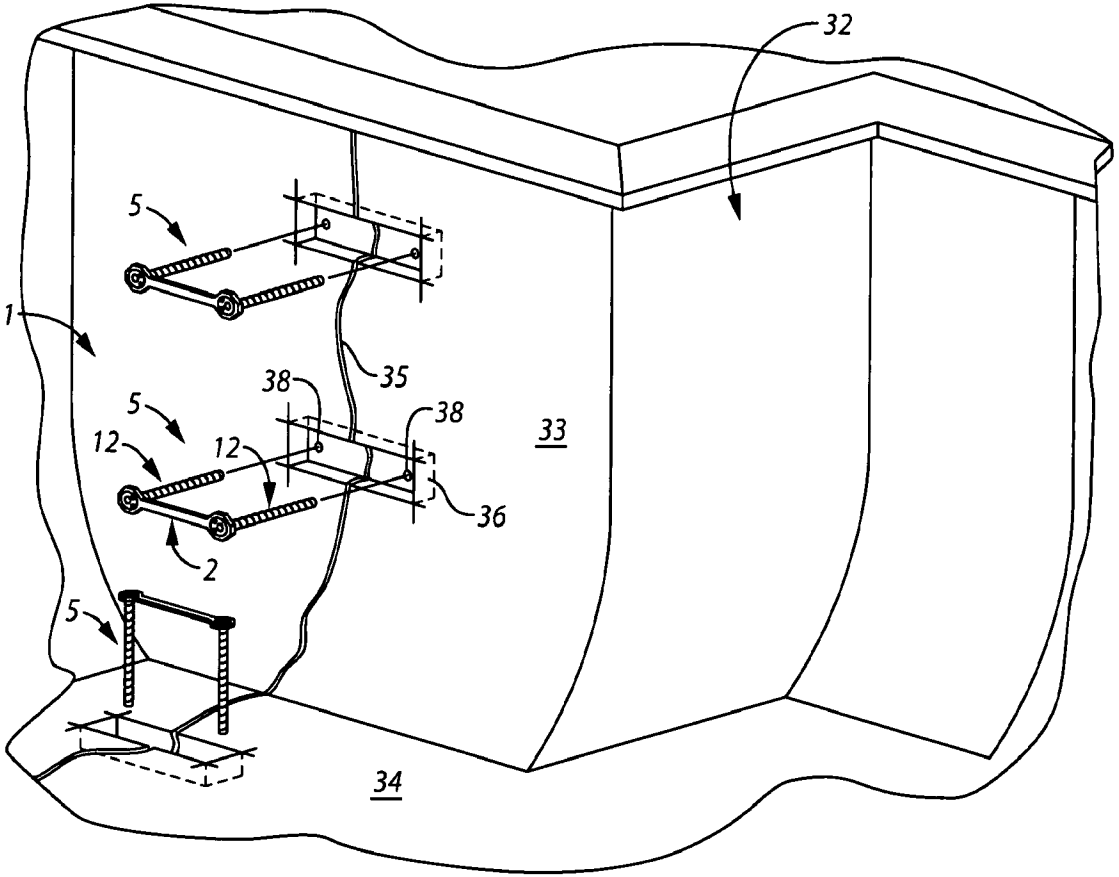
FIG. 4 is a perspective view of the pool, illustrating in exploded view multiple, assembled staples of the structural crack repair apparatus of the present invention positioned for insertion into each corresponding pair of rod apertures as a third step according to the method of the present invention.
Figure 5:
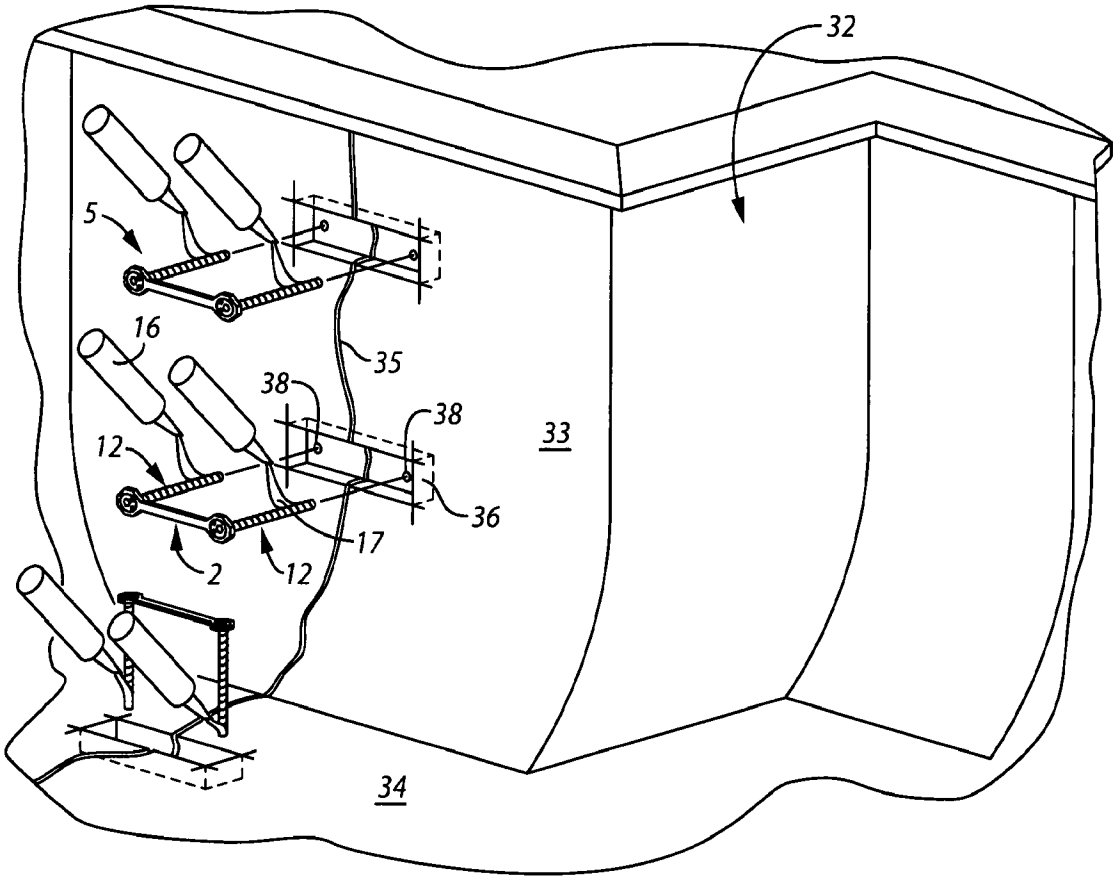
FIG. 5 is a perspective view of the pool, illustrating in exploded view application of an epoxy to the reinforcing rods of each staple prior to insertion of the reinforcing rods into each corresponding pair of rod apertures as a fourth step according to the method of the present invention.

As illustrated in FIG. 4, the reinforcing rods 12 are next assembled on each staple 5. As illustrated in FIG. 14, this is facilitated by inserting the reduced-diameter tip of each reinforcing rod 12 in the offset aperture 8 of each cam member 7, as heretofore described. As illustrated in FIG. 5, a two-part, free-flowing, non-sag epoxy 17 is then applied from an epoxy container 16 to each reinforcing rod 12. Alternatively, the epoxy 17 may be applied directly to each rod aperture 38. A small quantity of epoxy 17 may be used to secure the reduced-diameter tip 13 of each reinforcing rod 12 in the corresponding offset aperture 8 of the cam member 7.

Figure 10:
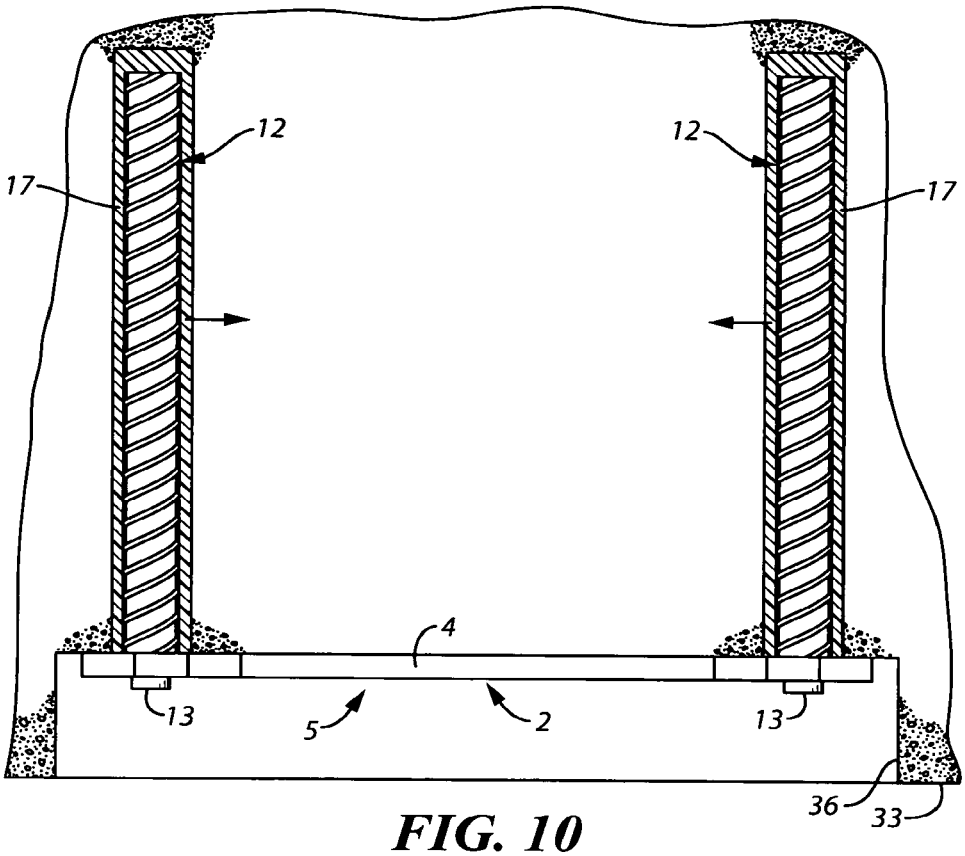
FIG. 10 is a top view of the staple of FIG. 9, prior to rotation of the cam members and reinforcing rods.

As illustrated in FIGS. 6 and 10, the reinforcing rods 12 of each staple 5 are next inserted into the respective rod apertures 38 of each excavation cavity 36 until the torque plate 2 is flush with the rear or bottom wall of the excavation cavity 36. The epoxy 17 is then allowed to cure for a period of time, depending on the particular epoxy used.

Figure 7:
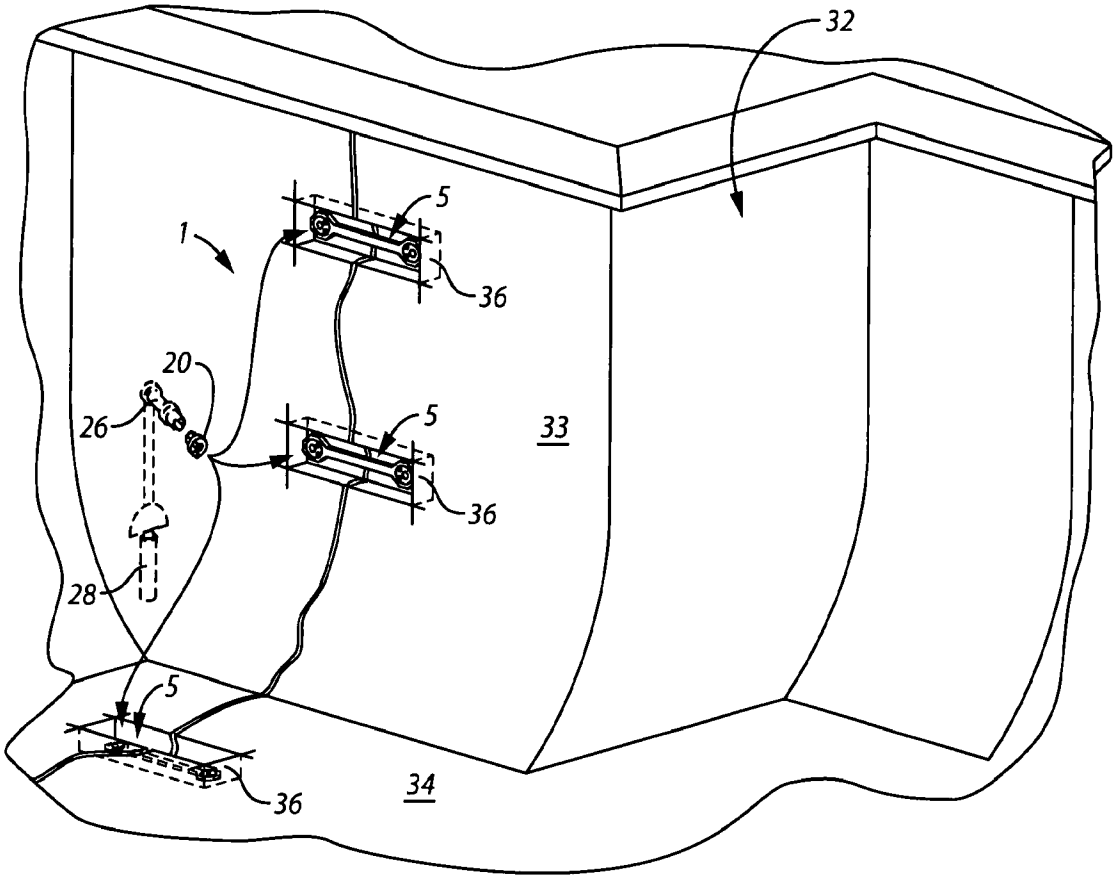
FIG. 7 is a perspective view of the pool, illustrating in exploded view removable engagement of a cam-driving tool, ratchet and handle assembly (shown in phantom) with the cam member of each staple to facilitate rotation of the cam member and engagement of the reinforcing rods against the interiors of the rod cavities as a sixth step according to the method of the present invention.
Figure 8:
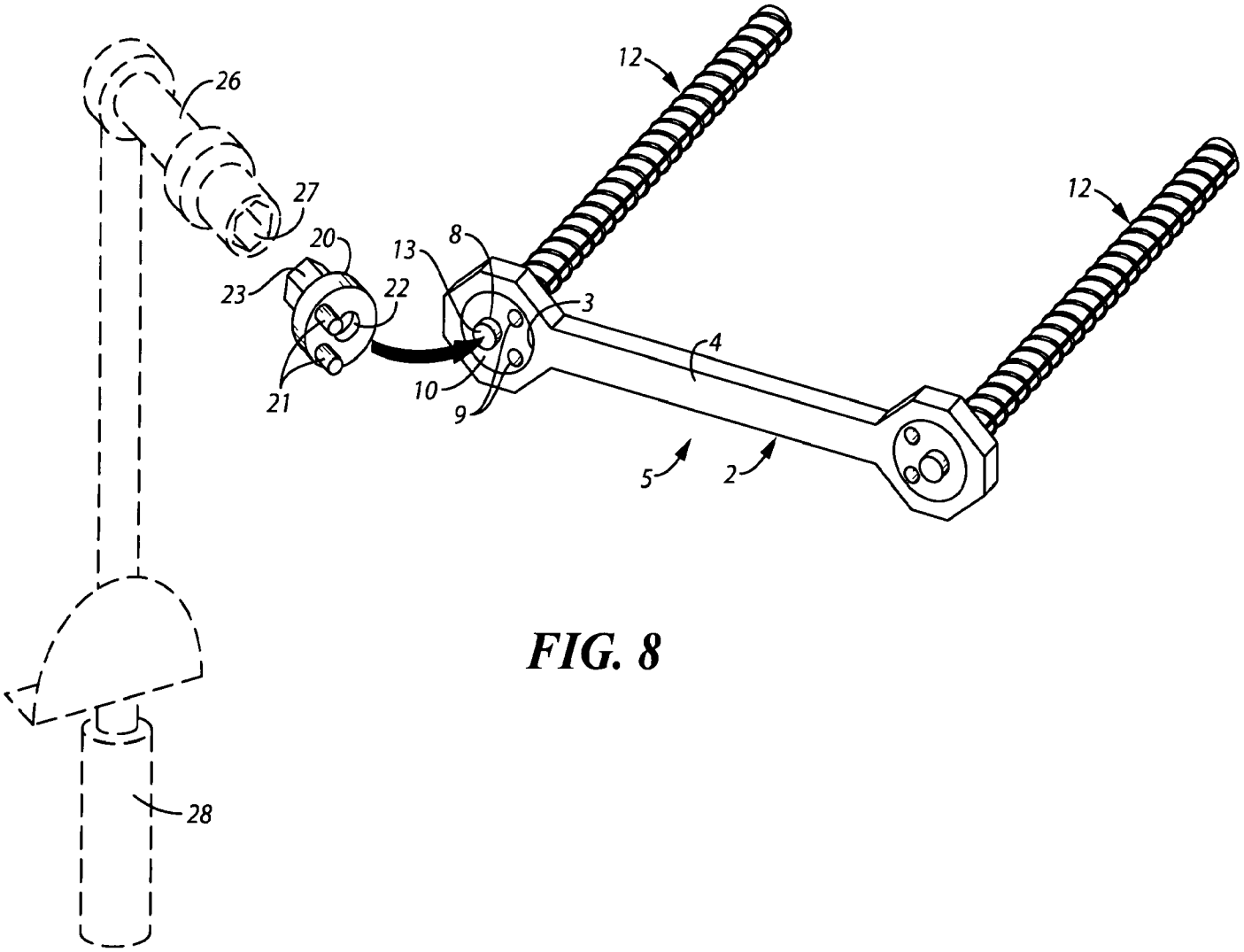
FIG. 8 is a perspective view of a staple, illustrating in exploded view a cam-driving tool (in solid lines) and a ratchet and handle assembly (in phantom) which may be conventional and is used to rotate each cam member on the torque plate element of the staple and cause secure engagement of the reinforcing rods against the interior surfaces of the rod apertures.

As illustrated in FIGS. 7 and 8, the reinforcing rods 12 of each staple 5 are next forced inwardly toward each other by rotation of the cam members 7 in the respective cam-receiving apertures 3. As illustrated in FIG. 8, this is carried out using a cam-driving tool 20, which may be conventional. Such a cam-driving tool 20 typically includes a pair of spaced-apart pegs 21 and an offset or eccentric rod aperture 22. A nut 23 is provided on the cam-driving tool 20 for engagement by the socket 27 of a ratchet 26. A handle 28 engages the ratchet 26 for rotation of the cam-driving tool 20.

Figure 9:
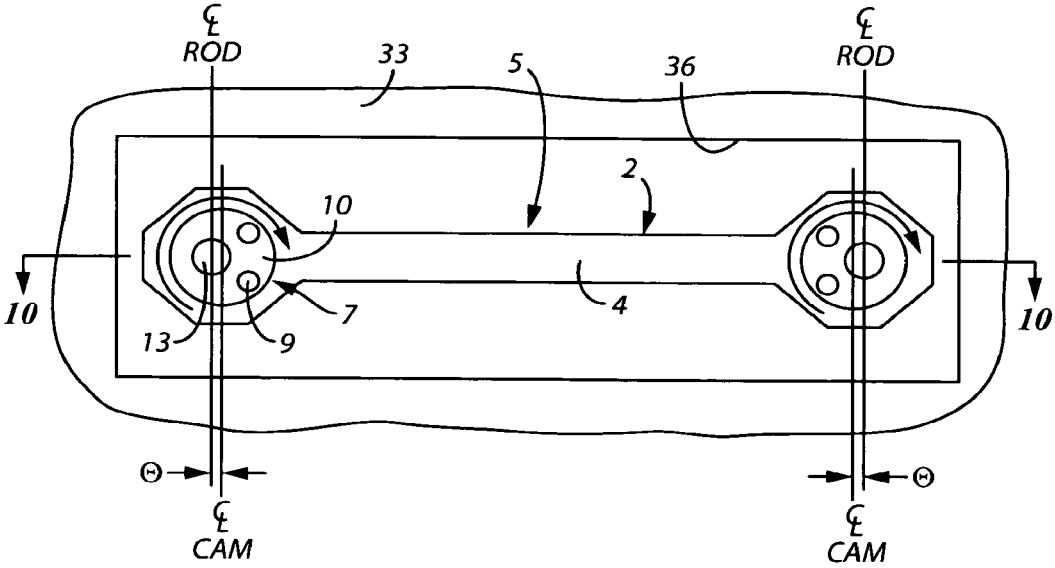
FIG. 9 is a front view of a staple inserted in an excavation cavity in a surface, illustrating clockwise rotation of the cam members on the torque plate to cause rotation and radial displacement of the reinforcing rods into tight engagement with the interior surfaces of the respective rod apertures in which they are inserted.

The cam-driving tool 20 engages each cam member 7 by inserting the pegs 21 of the cam-driving tool 20 in the respective cam tool apertures 9 of the cam member 7 and inserting the reduced-diameter tip 13 of the reinforcing rod 12, which protrudes from the offset aperture 8, into the rod aperture 22 of the cam-driving tool 20. As illustrated in FIGS. 9 and 10, the cam tool apertures 9 of each cam member 7 are initially located at the inside position and the offset aperture 8 of each cam member 7 is located at the outside position. By operation of the cam-driving tool 20, each cam member 7 is rotated in the clockwise direction, as indicated by the curved arrows in FIG. 9. This causes rotation of the offset aperture 8 of each cam member 7 from the outside position of FIG. 9 to the upper position of FIG. 11, thereby facilitating radial displacement of the reinforcing rods 12 toward each other in the respective rod apertures 38. Accordingly, prior to rotation of the cam members 7, the reinforcing rods 12 are positioned in approximately the center of each rod aperture 38, as illustrated in FIG. 10. After rotation of the cam members 7, the reinforcing rods 12 engage the inner surface of the respective rod apertures 38 at a force of approximately 60 torque-pounds of resistance, as illustrated in FIG. 12. This substantially reinforces each staple 5 in the corresponding excavation cavity 36.

A light coating of epoxy (not illustrated) is then coated over the entire surface of the torque plate 2 and cam members 7 of each staple 5. Finally, each excavation cavity is filled in using a non-shrinking cement (not illustrated), thereby covering the torque plate 2, cam members 7 and reduced-diameter rod tips 13 of each staple 5.

While the preferred embodiments of the invention have been described above, it will be recognized and understood that various modifications can be made in the invention and the appended claims are intended to cover all such modifications which may fall within the spirit and scope of the invention.

What is claimed is:

1. A method of repairing a crack in a surface, comprising:

providing at least one staple comprising an elongated torque plate, a pair of cam members rotatably carried by said torque plate and a pair of reinforcing rods engaging said pair of cam members, respectively;

providing an excavation cavity in said surface in intersecting relationship to said crack;

providing a pair of rod apertures in said surface on opposite sides of said crack;

inserting said pair of reinforcing rods into said pair of rod apertures, respectively;

causing radial displacement of said pair of reinforcing rods with respect to a geometrical center of said pair of cam members, respectively, by rotating said pair of cam members on said torque plate; and providing a cement material and filling said excavation cavity with said cement material after said pair of reinforcing rods have been radially displaced.

2. The method of claim 1 an excavation cavity in said surface in intersecting relationship to said crack and wherein said providing a pair of rod apertures in said surface on opposite sides of said crack comprises providing said pair of rod apertures in a rear surface of said excavation cavity.

3. The method of claim 2 further comprising providing an epoxy on said pair of reinforcing rods, respectively, prior to said inserting said pair of reinforcing rods into said pair of rod apertures, respectively.

4. The method of claim 1 further comprising placing an epoxy into said pair of rod apertures, respectively, prior to inserting said pair of reinforcing rods into said pair of rod apertures.

5. The method of claim 4 further comprising allowing said epoxy to at least partially cure prior to radially displacing said pair of reinforcing rods.

6. A method of repairing a crack in a surface, comprising:

providing at least one staple including an elongated torque plate and a pair of reinforcing rods connected to opposing ends of the elongated torque plate, at least one of the reinforcing rods being movably connected to the elongated torque plate;

forming at least one excavation cavity in the surface in intersecting relationship with the crack;

forming a pair of rod apertures in the at least one excavation cavity on opposing sides of the crack;

inserting the pair of reinforcing rods in the pair of rod apertures of the at least one excavation cavity, respectively; and moving at least one of the pair of reinforcing rods toward the other of the pair of reinforcing rods; and filling the at least one excavation cavity with cement after said reinforcing rod have been moved towards the other reinforcing rod.

7. The method of claim 6, further comprising the step of providing epoxy to at least one of the pair of reinforcing rods and the pair of rod apertures.

8. The method of claim 6 further comprising placing an epoxy into said pair of rod apertures, respectively, prior to inserting said pair of reinforcing rods into said pair of rod apertures.

9. The method of claim 8 further comprising allowing said epoxy to at least partially cure prior to moving at least one of the pair of reinforcing rods toward the other of the pair of reinforcing rod.

10. A method of repairing a crack in a wall surface of a pool, comprising:

forming at least one excavation cavity in the wall surface in transverse and intersecting relationship to the crack;

drilling a pair of spaced-apart rod apertures in the at least one excavation cavity on opposing sides of the crack;

providing at least one staple including an elongated torque plate having opposing ends and a pair of spaced-apart reinforcing rods connected to the opposing ends of the elongated torque plate, at least one of the pair of spaced-apart reinforcing rods being movably connected to the elongated torque plate;

inserting the pair of reinforcing rods in the pair of rod apertures of the at least one excavation cavity, respectively;

moving at least one of the pair of reinforcing rods toward the other of the pair of reinforcing rods to minimize propagation of the crack; and filling the at least one excavation cavity with a non-shrinking cement after moving the at least one reinforcing rod toward the other reinforcing rod.

11. The method of claim 10, wherein said step of inserting the pair of reinforcing rods in the pair of rod apertures comprises positioning the pair of reinforcing rods approximately in the center of each of the pair of spaced-apart rod apertures, respectively.

12. The method of claim 10, further comprising the step of providing epoxy to at least one of the pair of reinforcing rods and the pair of rod apertures prior to the step of inserting the pair of reinforcing rods in the pair of rod apertures of the at least one excavation cavity, respectively.

13. The method of claim 10 further comprising placing an epoxy into said pair of spaced-apart rod apertures, respectively, prior to moving at least one of the pair of reinforcing rods toward the other of the pair of reinforcing rods.

14. The method of claim 13 further comprising allowing said epoxy to at least partially cure prior moving at least one of the pair of reinforcing rods toward the other of the pair of reinforcing rods to minimize propagation of the crack.

15. The method of claim 10, wherein said step of forming at least one excavation cavity in the wall surface comprises cutting a plurality of excavation cavities in the wall surface in spaced-apart relationship to each other.

16. The method of claim 15, wherein each of said plurality of excavation cavities has an elongated, rectangular shape.

17. The method of claim 16, wherein the elongated torque plate has a rectangular shape.

18. The method of claim 10, wherein the at least one of the reinforcing rods that is movably connected to the elongated torque plate is connected to a circular cam member at a location offset from a center of the circular cam member, and the circular cam member is rotatably received in a circular cam-receiving aperture extending though at least one of the opposing ends of the elongated torque plate.

19. The method of claim 18, wherein the circular cam member includes at least one cam tool aperture extending through the circular cam member at a location offset from the center of the circular cam member.

20. The method of claim 18, further comprising the step of coating the torque plate and the at least one cam member with epoxy prior to the step of inserting the pair of reinforcing rods in the pair of rod apertures of the at least one excavation cavity, respectively.

21. The method of claim 18, wherein said step of moving at least one of the pair of reinforcing rods toward the other of the pair of reinforcing rods comprises rotating the circular cam member to move the at least one of the reinforcing rods connected to the circular cam member toward the other of the pair of reinforcing rods.

22. The method of claim 21, wherein said step of rotating the circular cam member comprises rotating the circular cam member to move the at least one of the reinforcing rods connected to the circular cam member from an outside position to an intermediate position.

* * * * *